US006719649B1

(12) United States Patent
Lin

(10) Patent No.: US 6,719,649 B1
(45) Date of Patent: Apr. 13, 2004

(54) BALL SERVER WITH DELAY ELEMENT FOR DELAYING TIME PERIOD OF SERVING A BALL

(76) Inventor: Chiu Yuan Lin, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/309,372

(22) Filed: Dec. 5, 2002

(51) Int. Cl.[7] ..... A63B 71/00
(52) U.S. Cl. ..... 473/417; 473/422
(58) Field of Search ..... 473/417, 422, 473/453, 133, 138; 273/317.6, 317.2, 332, 390, 391, 407; 124/61, 17

(56) References Cited

U.S. PATENT DOCUMENTS 1,545,959 A * 7/1925 Huyler ..... 473/133
3,183,000 A * 5/1965 Dix ..... 473/417
5,221,081 A * 6/1993 Rooks ..... 124/16
5,590,876 A * 1/1997 Sejnowski ..... 473/417
5,597,160 A * 1/1997 Mims ..... 124/16
5,800,288 A * 9/1998 Mims ..... 473/417

* cited by examiner

*Primary Examiner*—Stephen Blau
*Assistant Examiner*—M. Chambers

(57) ABSTRACT

A ball server includes a server seat, a movable rod inserted into the server seat, an elastomer, a touch plate, and a delay element within the server seat. In using, the movable rod is pressed so as to buckle the touch plate and the movable rod is interacted with the delay element, the ball will flatly place on the movable rod. When the ball server is actuated, the movable rod will be driven by the delay element so that it rises slowly, but after a time period, the action of the delay element is released and the movable rod rises rapidly and at the same time, the ball rises. When the movable rod is operated by the delay element, the batter can prepare for next beating.

8 Claims, 5 Drawing Sheets

BALL SERVER WITH DELAY ELEMENT FOR DELAYING TIME PERIOD OF SERVING A BALL

FIELD OF THE INVENTION

The present invention relates to ball servers, and particularly to a ball server having a delay element for delaying a movable rod so that the batter has a delay time for preparing the next beating operation

BACKGROUND OF THE INVENTION

Baseball is a popular exercise in many countries. Unluckily a baseball game must be completed by many sporters so that if only one people desires to play baseball, he (or she) will feel convenient. To improve this defect, in the prior art, a ball server is developed to improve the defect in the prior art. In one prior art, the ball server emits a ball which has a flying path simulated the traveling path of the ball from a pitcher. However, this prior art needs a larger area so that it is inconvenient for many users.

Although the batter may throw a ball upwards and then beats the ball, but it will be affected by the behavior of the batter so that the path is unfair or is beneficial to the batter himself (or herself). Moreover, after the ball is thrown out, the user must hold the bat quickly. The time period is too short to be reacted by the batter.

SUMMARY OF THE INVENTION

Accordingly, the primary object of the present invention is to provide a ball server including a server seat, a movable rod inserted into the server seat, an elastomer, a touch plate, and a delay element within the server seat. In using, the movable rod is pressed so as to buckle the touch plate and the movable rod is interacted with the delay element, the ball will flatly place on the movable rod. When the ball server is actuated, the movable rod will be driven by the delay element so that it rises slowly, but after a time period, the action of the delay element is released and the movable rod rises rapidly and at the same time, the ball rises. When the movable rod is operated by the delay element, the batter can prepare for next beating.

The various objects and advantages of the present invention will be more readily understood from the following detailed description when read in conjunction with the appended drawing.

DETAILED DESCRIPTION OF THE PREFERRED EMBODIMENTS

Figure 1:
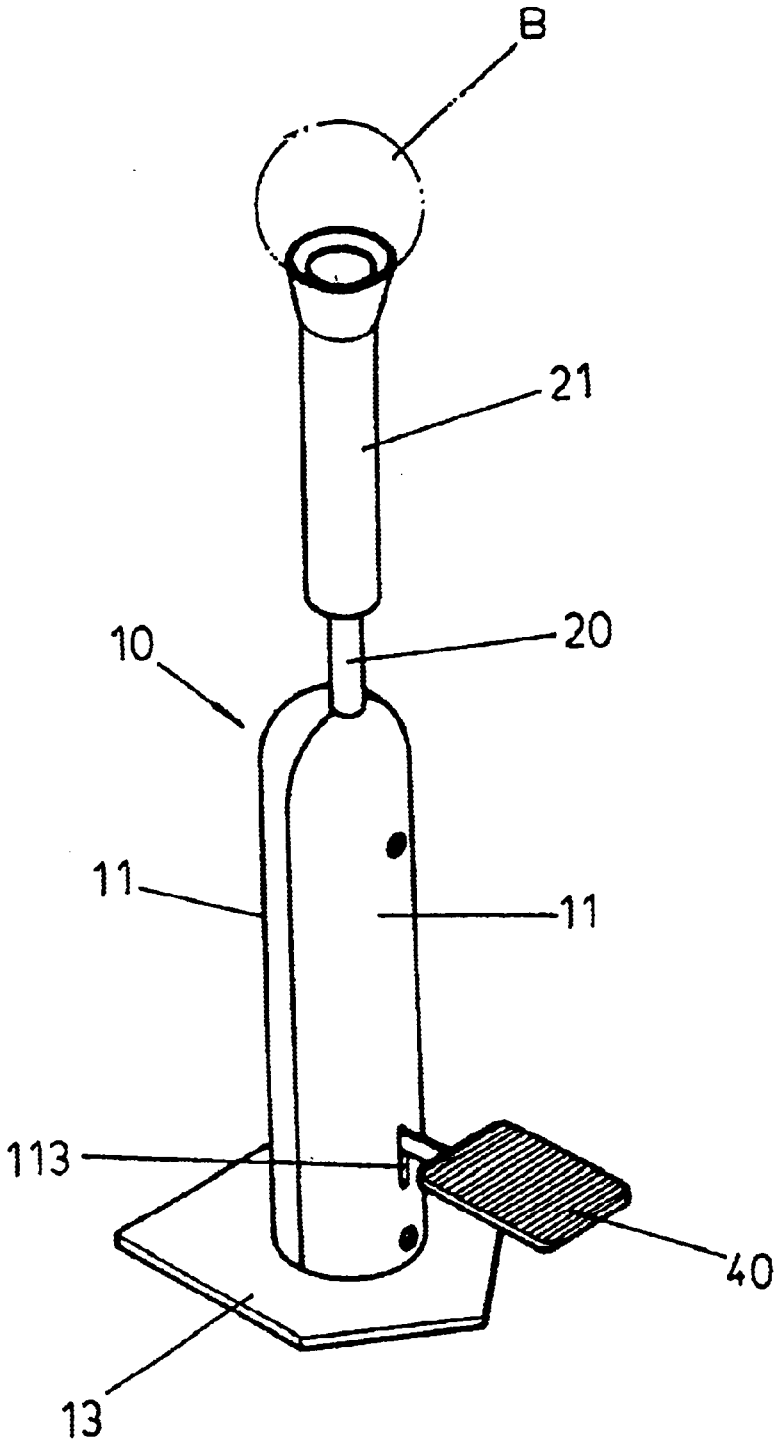
FIG. 1 is a perspective view of the ball server of the present invention.
Figure 2:
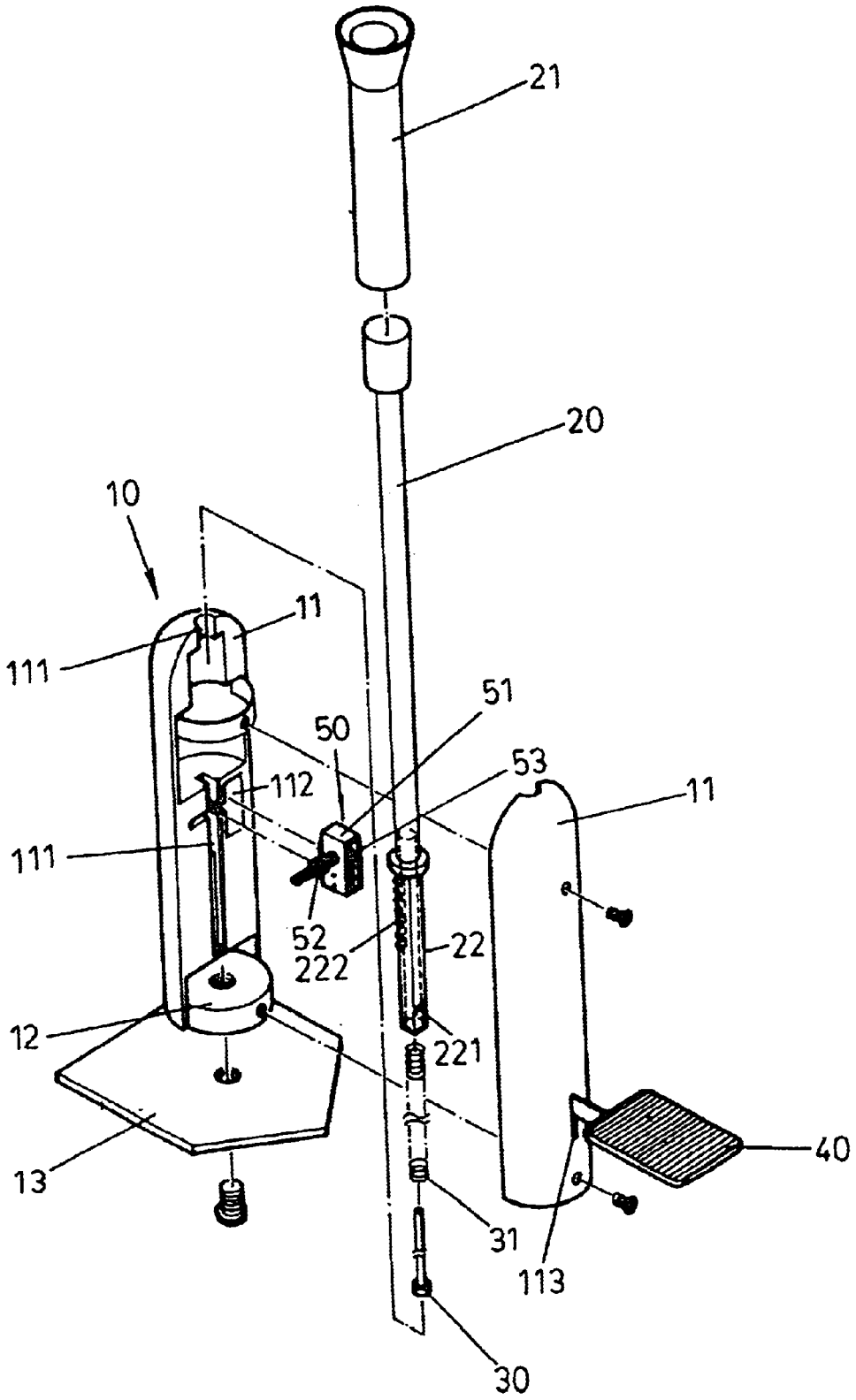
FIG. 2 is an exploded perspective view of the present invention.
Figure 3:
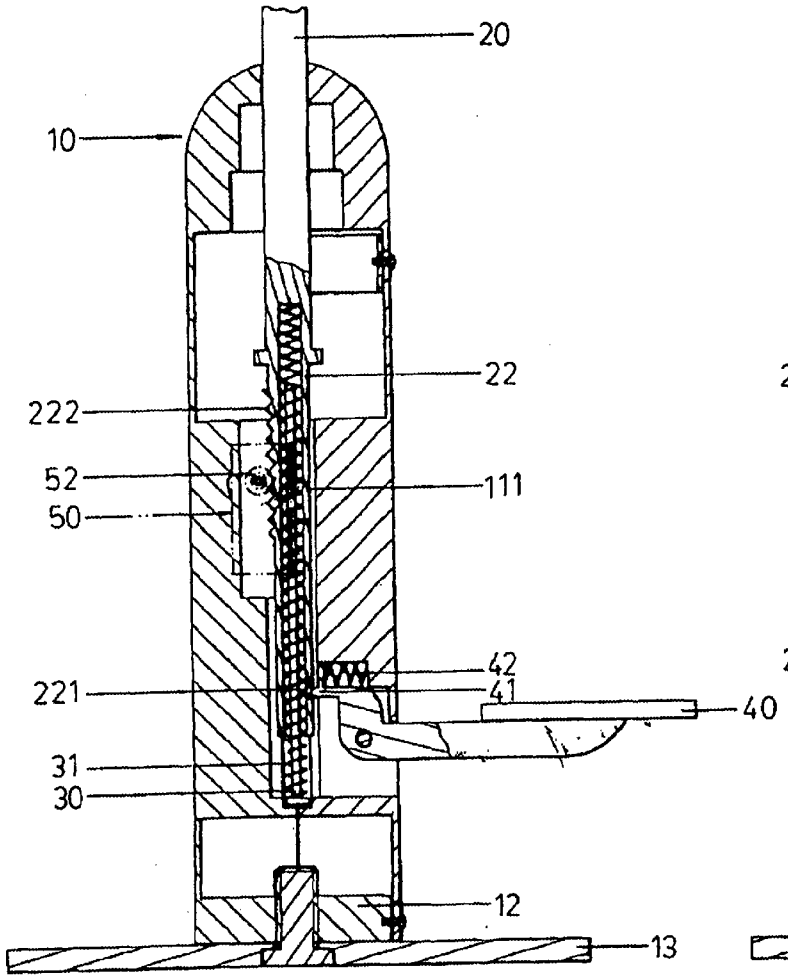
FIG. 3 is a structural cross sectional view showing the movable rod and retaining plate of the present invention.

Referring to FIGS. 1 and 3, the ball server of the present invention is illustrated. Basically, the ball server of the present invention includes a server seat 10 which is formed by two casing halves 11. An interior of the server seat 10 has a longitudinal through hole 111. A middle section of the through hole 111 is installed with a concave seat 112. A side of the bottom of the through hole 111 has a slot 113.

Besides, a bottom of the server seat 10 has a connecting seat 12 for being locked to a bottom plate 13. Thereby, the server seat 10 can be steadily placed on a ground. A movable rod 20 passes through the server seat 10. The main body of the movable rod 20 passes through the through hole 111 of the server seat 10. A part of the movable rod 20 protrudes out of the server seat 10. A top of the movable rod 20 is installed with a ball seat 21 for placing a ball B. A bottom of the movable rod 20 in the server seat 10 has a buckle plate 22. The buckle plate 22 is further installed with a first buckle 221 and a driven portion 222. An elastomer 30 is installed at a bottom of the through hole 111. The elastomer 30 is a compressible spring for positioning a through rod 41 so as to form an upward elastic force applied to the movable rod 20.

Furthermore, with reference to FIG. 3, one side of the server seat 10 is installed with a touch plate 40 which can be touched by a batter. The touch plate 40 is pivotally installed to the slot 113. The touch plate 40 has a second buckle 41. The second buckle 41 can be inserted into the standby state to be buckled to the first buckle 221 of the buckle plate 22. Thereby, when the movable rod 20 is pressed into the server seat 10, the second buckle 41 of the touch plate 40 is buckled to the first buckle 221 of the buckle plate 22 to restrain the movable rod 20 to be ejected upwards. Another restoring element 42 serves to move the touch plate 40 to return to the unbuckling condition.

Figure 4B:
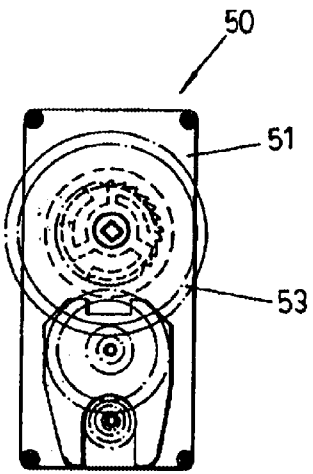
FIGS. 4A and 4B are structural schematic view of the delay element of the present invention.
Figure 4A:
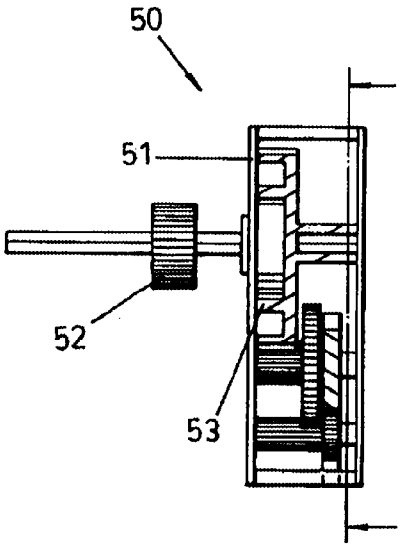

Further, an interior of the server seat 10 is installed with a delay element 50. The delay element 50 is installed within the concave seat 112 of the server seat 10 and has a driven element 52 driving by the driving portion 222 of the buckle plate 22 and has a delay unit 53 which can delay the operation time of the driving portion 222 and the delay unit 53 of the buckle plate 22. Referring to FIGS. 4A and 4B, the delay element 50 has a gear set for forming the delay unit 53 and is in a case seat 51 of the delay element 50. The driving element 52 is a gear extended out of the case seat 51. The driving portion 222 of the buckle plate 22 is a rack with a predetermined length and is engagable with the driving element 52 of the delay element 50. The delay unit 53 of the delay element 50 has an effect of delaying the rack.

Moreover, when serving a ball, referring to FIG. 3, the movable rod 20 is pressed toward the server seat 10, then the first buckle 221 of the buckle plate 22 is buckled to the second buckle 41 of the touch plate 40 so that the movable rod 2 is buckled to the touch plate 40 and the driving portion 222 of the buckle plate 22 is in contact with the driving element 52 of the delay element 50. Thereby, the movable rod 20 is interacted with the delay element 50; as shown in FIG. 1. When the ball B is flatly placed on the ball seat 21 at the top of the movable rod 20, referring to FIG. 3, the elastomer 30 at the bottom of the server seat 10 is stored with a potential energy for ejecting the movable rod 20.

Figure 5:
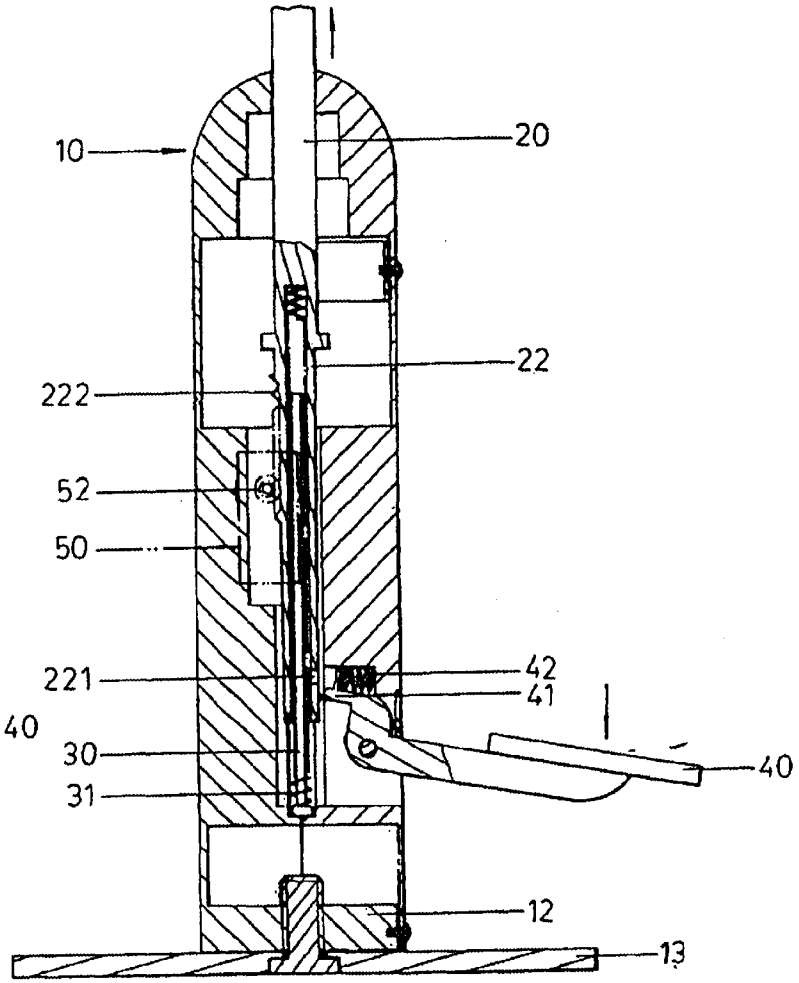
FIG. 5 is a cross sectional view showing the driving condition of the movable rod and the delay element of the ball server of the present invention.
Figure 6:
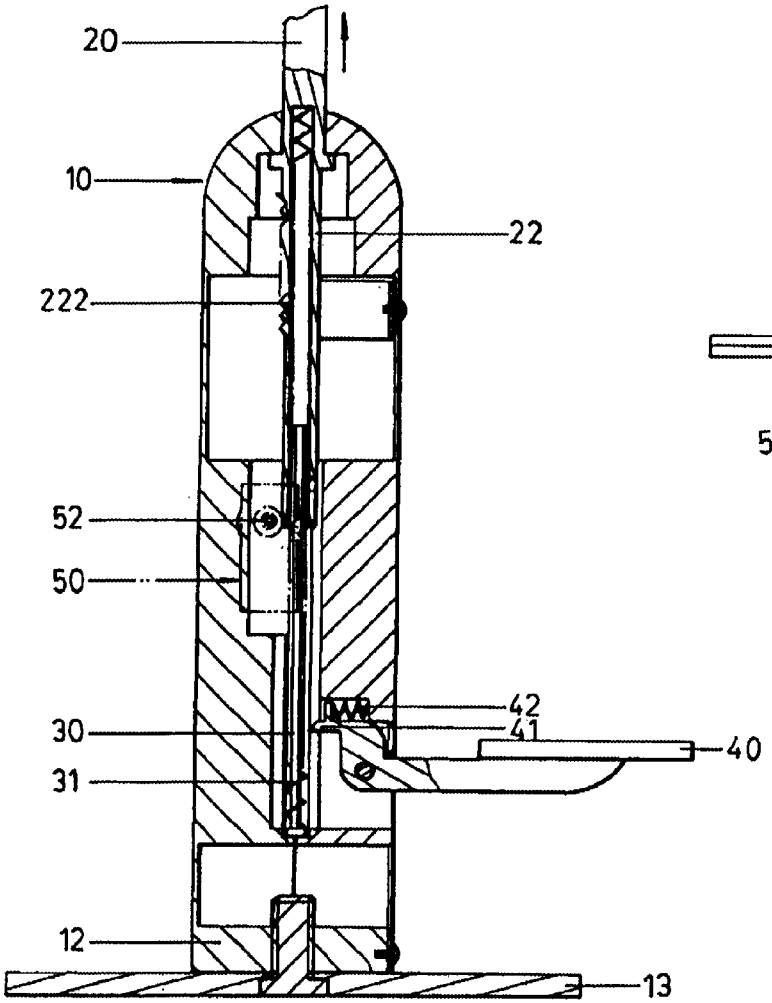
FIG. 6 is a cross sectional view showing the rising operation of the movable rod of the present invention.
Figure 7:
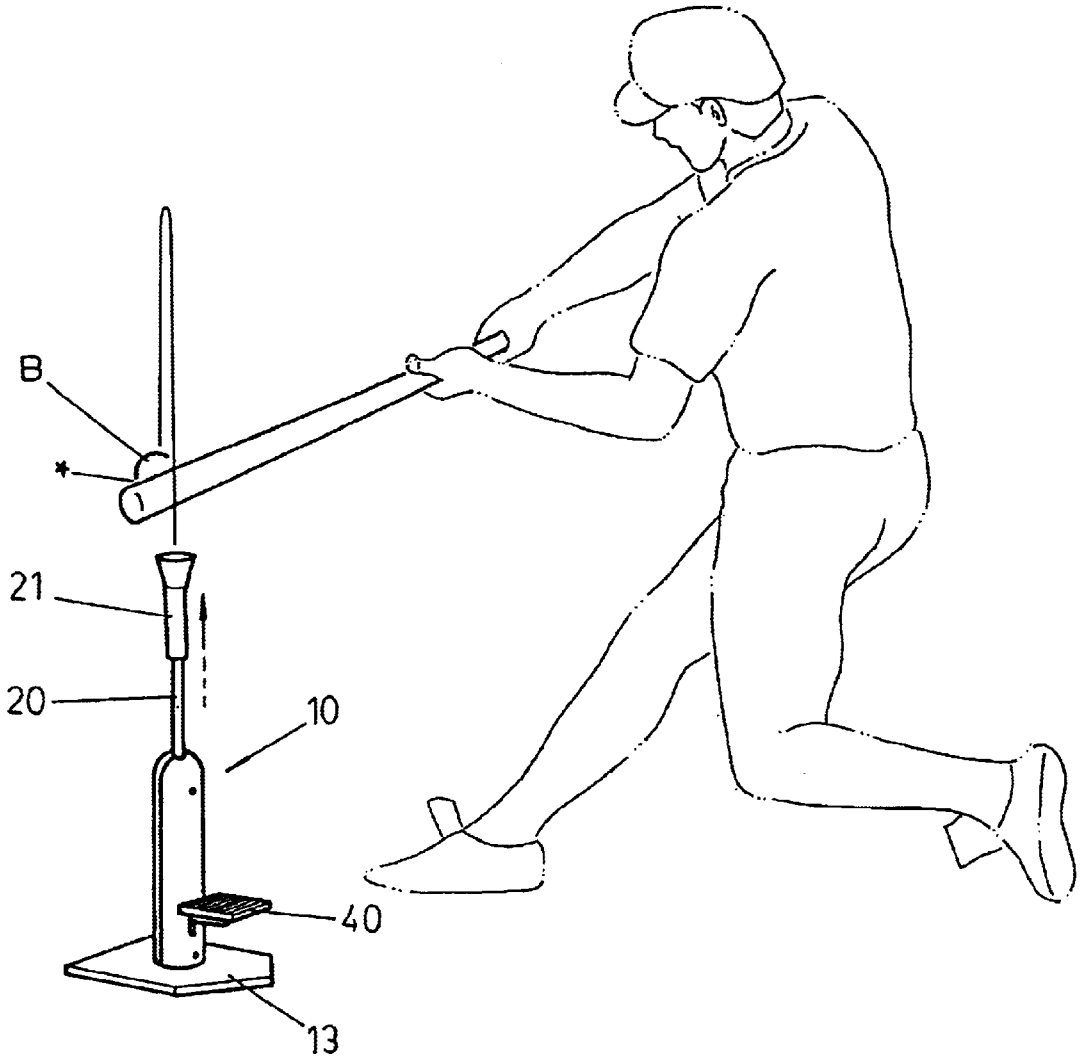
FIG. 7 shows one application of the ball server of the present invention.

When the ball server is operated, as shown in FIG. 5, the movable rod 20 is ejected upwards due to the action of the elastomer 30. Due to the action of the delay element 50, the movable rod 20 will rise up slowly. When the movable rod 20 is released from the action of the delay element 50, as shown in FIG. 6, the movable rod 20 can rise up rapidly with being driven by the delay element 50 and thus the ball also rises up. When the movable rod 20 is operated by the delay element 50, the batter can prepare for next beating, as shown in FIG. 7.

The delay unit of the delay element has an effect of delaying the rack by designing the number of teeth of the gear set and by rotation of the gear set. The elastomer is a compressing spring positioned by a rod.

The ball server of the present invention includes a server seat 10, a movable rod 20 inserted into the server seat 10, an elastomer 30, a touch plate 40, and a delay element 50 within the server seat 10. In using, the movable rod 20 is pressed so as to buckle the touch plate 40 and the movable rod 20 is interacted with the delay element 50, the ball will flatly place on the movable rod 20. When the ball server is actuated, the movable rod 20 will be driven by the delay element 50 so that it rises slowly, but after a time period, the action of the delay element 50 is released and the movable rod 20 rises rapidly and at the same time, the ball rises. When the movable rod 20 is operated by the delay element 50, the batter can prepare for next beating.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A ball server comprising:

a server seat flatly placed one a ground;

a movable rod having a first part in the server seat and a second part out of the server seat, a top of the second part having a ball seat; a bottom of the first part having a buckle plate; and the buckle plate having a first buckle and a driving portion;

an elastomer at a bottom of the server seat for ejecting the movable rod upwards;

a touch plate pivotally installed at one side of a bottom of the server seat and having a second buckle having a portion within the server seat to be buckled with the first buckle so as to confine an ejecting length of the movable rod; and a delay element in the server seat and having a driving element which is interacted with the driving portion of the buckle plate; the delay element further having a delay unit for delaying an interaction time of the driving portion of the buckle plate and the driving element; and wherein when serving a ball, the movable rod is pressed toward the server seat, then the first buckle of the buckle plate is buckled to the second buckle of the touch plate so that the movable rod is buckled to the touch plate and the driving portion of the buckle plate is in contact with the driving element of the delay element; thereby, the movable rod is interacted with the delay element; when the ball is flatly placed on the ball seat at the top of the movable rod, the elastomer at the bottom of the server seat is stored with a potential energy for ejecting the movable rod;

when the ball server is operated, the movable rod is ejected upwards due to the action of the elastomer; by action of the delay element, the movable rod will rise up slowly; when the movable rod is released from the action of the delay element; the movable rod rises up rapidly with being driven by the delay element and thus the ball also rises up; when the movable rod is operated by the delay element, the batter prepares for next beating.

2. The ball server as claimed in claim 1, wherein the ball server includes a server seat which is formed by two casing halves; an interior of the server seat has a longitudinal through hole; a middle section of the through hole is installed with a concave seat for receiving the delay element; a side of the bottom of the through hole has a slot; besides, a bottom of the server seat has a connecting seat for being locked to a bottom plate; thereby, the server seat is steadily placed on a ground.

3. The ball server as claimed in claim 1, further comprising a restoring element for moving the touch plate to return to the unbuckling condition.

4. The ball server as claimed in claim 1, wherein the delay element has a gear set for forming the delay unit and the gear set is installed in a case seat of the delay element; the driving element is a gear extended out of the case seat; the driving portion of the buckle plate is a rack with a predetermined length and is engagable with the driving element of the delay element.

5. The ball server as claimed in claim 4, wherein the delay unit of the delay element has an effect of delaying the rack by designing the number of teeth of the gear set.

6. The ball server as claimed in claim 4, wherein the delay unit of the delay element has an effect of delaying the rack by rotation of the gear set.

7. The ball server as claimed in claim 4, wherein the delay unit of the delay element has an effect of delaying the rack by designing the number of teeth of the gear set and by rotation of the gear set.

8. The ball server as claimed in claim 1, wherein the elastomer is a compressing spring positioned by a rod.

* * * * *